US006405408B1

(12) United States Patent
Mavrofrides

(10) Patent No.: US 6,405,408 B1
(45) Date of Patent: Jun. 18, 2002

(54) HINGE SUPPORT APPARATUS AND METHOD

(76) Inventor: Demetrios C. Mavrofrides, 4311 Clay Canyon, Katy, TX (US) 77450

( * ) Notice: Subject to any disclaimer, the term of this patent is extended or adjusted under 35 U.S.C. 154(b) by 0 days.

(21) Appl. No.: 09/556,748

(22) Filed: Apr. 21, 2000

Related U.S. Application Data

(60) Provisional application No. 60/130,798, filed on Apr. 23, 1999.

(51) Int. Cl.[7] ..... E05D 5/00

(52) U.S. Cl. ..... 16/382; 296/37.9; 16/221; 16/254

(58) Field of Search ..... 16/382, 304, 306, 16/308, 281, 285, 286, 223; 188/268; 248/311.2, 309.1; 296/37.1, 37.8, 37.9; 312/242, 246–248, 319.1, 319.2

(56) References Cited

U.S. PATENT DOCUMENTS 4,275,913 A * 6/1981 Marcus ..... 296/37.1
4,462,630 A * 7/1984 Omata ..... 296/37.9
4,635,763 A * 1/1987 Omata ..... 188/268
4,660,881 A * 4/1987 Komeya et al. ..... 296/37.9
5,002,074 A * 3/1991 Kimisawa ..... 296/37.9
5,050,922 A * 9/1991 Falcoff ..... 296/37.3
5,875,521 A * 3/1999 Woo ..... 16/280
6,076,878 A * 6/2000 Isano ..... 16/82

OTHER PUBLICATIONS

Three (3) Photographs of Actual Center Console of a Ford Mustang Automobile Manufactured in the 1987–1993 Time Frame, (2 pages).

* cited by examiner

*Primary Examiner*—Chuck Y. Mah
(74) *Attorney, Agent, or Firm*—E. Randall Smith

(57) ABSTRACT

An apparatus for supporting a hinge assembly of an accessory door, the accessory door moveable between open and closed positions relative to a base and including a first arm, the hinge assembly including a spring, the spring engageable between the base and the first arm, the apparatus including a plate rigidly engageable with the base, the plate including a spring anchor mechanism capable of engaging the spring, and at least one connector capable of connecting the plate and the base, whereby the accessory door is moveable between open and closed positions without interference by the plate or the connector(s).

24 Claims, 6 Drawing Sheets

HINGE SUPPORT APPARATUS AND METHOD

CROSS REFERENCE TO RELATED APPLICATIONS

The present application claims the benefit of U.S. Provisional Application Ser. No. 60/130,798, filed Apr. 23, 1999, entitled Apparatus and Method for Providing Support For a Moveable Member, which is incorporated herein by reference in its entirety.

STATEMENT REGARDING FEDERALLY SPONSORED RESEARCH AND DEVELOPMENT

Not applicable.

BACKGROUND OF THE INVENTION

The present invention relates generally to the field of apparatus and methods for allowing the opening and closing, turning or pivoting of a moveable member, such as accessory door, cover, lid or flap. More particularly, the present patent application relates to an apparatus and method useful for supporting, repairing or reinforcing the hinge assembly of a door, cover, lid, flap or other moveable member.

Various types of moveable members, such as doors, covers, lids and flaps, are used in automobiles, other types of vehicles, appliances, home and office equipment and various other devices for providing access to or to cover or protect various types of objects or spaces, such as switches, storage spaces, ash trays, cigarette lighters, etc. Such moveable members are referred to herein as "accessory doors." For different reasons, it is desirable and can be important, or critical, that the accessory doors be operational to enable use of the spaces/objects accessed via the doors and to avoid potential undue expense and undesirable situations.

For example, one type of accessory door is an ash tray cover found in the driver's compartment center console of an automobile, such as a Ford® model Mustang® or Thunderbird®. These accessory doors typically provide access to an ash tray and a cigarette lighter. In addition to use for its intended function, the ash tray is often used as a holder for various items, such as money, toll way tokens, gate entry cards and other valuables. The cigarette lighter, in addition to use for its intended function, is often used for various additional functions, such as a power outlet for cellular telephones, automobile battery chargers, radar detectors and other devices.

If such center console ash tray accessory doors become difficult, or impossible, to move between open and closed positions, the above functions may become difficult or impossible to achieve. For example, if the door becomes essentially stuck in the open position, any money or other valuables or items retained in the ash tray would remain uncovered and thus potentially visible through the automobile windows. This could lead to vandalism of the automobile, or to decrease the risk of vandalism, cause the operator not to use the ash tray as a holder for such items. For another example, if the door fails by mistakenly closing while the driver is smoking, the driver may mistakenly discard ashes, or even put out the cigarette, on the top of the ash tray cover or elsewhere in the driver's compartment. As a result, there may be undue expense to clean the driver's compartment or replace a burned ash tray cover or other parts of the automobile, particularly if a fire is started due to the ash droppings outside the ash tray. Further, the driver could become distracted. Thus, it is generally desirable that moveable members, such as accessory doors, covers, lids or flaps, used in automobiles, other types of vehicles, appliances, home and office equipment and various other devices be operational and moveable between open and closed positions as generally originally intended.

The assemblies, or mechanisms, that enable the opening and closing, turning or pivoting of accessory doors, referred to herein as "hinge assemblies", sometimes malfunction, wear or break. If the hinge assembly is not completely inoperable, it may nevertheless render the associated accessory door not easily moveable between open and closed positions. As a result, the accessory doors can be rendered partially or completely inoperable, such that, for example, when the accessory door is in a closed position, the objects or spaces the accessory door was intended to access can become difficult or impossible to be accessed. Likewise, when the accessory door is in an open position or is completely removed, the objects or spaces the accessory door was intended to conceal will not be concealed, potentially causing undesired expense, problems and inconveniences, such as described above.

Many such hinge assemblies have numerous parts, including moving and interacting parts, in a confined space. Thus, it is believed to be generally difficult to access and effectively reinforce, support or repair the parts of a hinge assembly. In fact, no repair, reinforcement or support kits are known or believed to exist for such hinge assemblies. For example, owners/users of 1987–1993 Ford® Mustangs® automobiles have been known to "jerry rig" the center console ash tray doors in a closed position with Velcro, by affixing weights such as by taping quarters near the door edge, by deforming a spring component of the hinge assembly or by causing the cigarette lighter to protrude upwardly. These methods are believed to be temporary at best, and are not believed to make the doors moveable between open and closed positions as originally intended, or smoothly, or to render the doors otherwise operable as is generally desirable.

Thus, there remains a need for apparatus and methods to reinforce, support and/or repair assemblies, or mechanisms, that enable the opening and closing, turning or pivoting of moveable members, such as doors, covers, lids or flaps, used in automobiles, other types of vehicles, appliances, home and office equipment and various other devices. Preferably, the apparatus and methods may be simple, cost effective and/or easy to implement. Ideally, the apparatus and methods can provide permanent, or relatively permanent, support for hinge assemblies, alleviating the need for further repair. Further, it would be beneficial if the apparatus and methods would render the doors operable as generally originally intended, or designed.

BRIEF SUMMARY OF THE INVENTION

In accordance with the present invention, there is provided an apparatus for supporting a hinge assembly associated with an accessory door, the accessory door being moveable between open and closed positions relative to a base and including a first arm, the hinge assembly including a spring and the spring engageable between the base and the first arm. The apparatus includes a plate rigidly engageable with the base the plate and including a spring anchor mechanism that is capable of engaging the spring and at least one connector capable of connecting the plate and the base without interfering with the accessory door as the accessory door is moved between open and closed positions.

In some embodiments, the plate is engageable with a spring tab of the base. Further a spring reinforcing member may be used that is engageable with the plate and the spring tab. The spring reinforcing member may be a backing. The plate in some embodiments can be disposed angularly relative to the base. At least one washer may be disposed between the connector(s) and the base.

The accessory door may include a second arm movably engageable with the base and the apparatus including a first pin engageable with the second arm and the base. A first pin retention member may be included that is engageable with the first pin and disposed between the second arm and the base. In some embodiments, the first pin is a screw and the first pin retention member is a nut. The second arm of the accessory door may be modified to allow the accessory door to be moveable between open and closed positions without interference by the first pin retention member.

The base may include a finger, and if so, the first arm of the accessory door may be moveably engageable with the finger, the apparatus further including a second pin engageable between the finger and the first arm. A second pin retention member may be included that is engageable with the second pin and capable of connecting the second pin with the finger. The second pin of certain embodiments is a screw having a corresponding second pin retention member that is a nut.

The first arm of the accessory door may include a stud movably engageable with the finger, the apparatus including a passage formed into the first arm and the stud, whereby the second pin is extendable through the passage. A buffer member may be disposed between the second pin retention member and the finger, and the stud may be reduced in length to allow the second pin retention member to engage the second pin. In some embodiments, the accessory door may be ash tray cover.

The present invention may take the form of a repair kit for repairing a hinge assembly that enables movement of an accessory door between open and closed positions relative to a base, the accessory door including first and second arms, the base including a finger, the hinge assembly including a biasing assembly and first and second hinges. The biasing assembly includes a spring, the spring engageable between the base and the first arm, the first hinge involving the second arm of the accessory door and the finger of the base and the second hinge involving the first arm of the accessory door. Such kit includes a plate engageable with the base and the spring, a first pin engageable with the second arm and the base, a first pin retention member engageable with the first pin and disposed between the base and the second arm, a second pin engageable with the first arm and the finger and a second pin retention member engageable with the second pin and capable of connecting the second pin with the finger.

Yet the present invention may take the form of a method for supporting a hinge assembly that enables movement of an accessory door between open and closed positions relative to a base, the accessory door including first and second arms, the hinge assembly including a spring, the spring engageable between the base and the first arm. One such method includes forming a spring support plate with a spring anchor mechanism, engaging at least one connector between the spring support plate and the base and engaging the spring with the spring anchor mechanism of the spring support plate, whereby the accessory door is moveable between open and closed positions without interference by the spring support plate or connector(s). The base may include a spring tab, the method further comprising engaging the at least one connector with the spring tab, the spring support plate and a spring reinforcement backing.

In some embodiments, the method may include engaging a first pin between the second arm of the accessory door and the base, and possibly also engaging a first pin retention member with the first pin and disposing the first pin retention member between the second arm of the accessory door and the base. Material may be removed from the second arm of the accessory door to allow the accessory door to move between open and closed positions without interference by the first pin retention member.

The base may include a finger and the first arm of the accessory door may be movably engageable with the finger. In such cases, the method could further include engaging a second pin between the finger and the first arm and engaging a second pin retention member with the second pin, whereby the second pin is movably connected with the finger. Further, the first arm of the accessory door may include a stud that is movably engageable with the finger, and the method further including forming a passage through the first arm and the stud and extending the second pin through the passage.

Accordingly, the present invention comprises features and advantages which enable it to substantially advance the technology associated with supporting, reinforcing and/or repairing assemblies, or mechanisms, that enable the opening and closing, turning or pivoting of moveable members, such as doors, covers, lids or flaps, used in automobiles, other types of vehicles, appliances, home and office equipment and various other devices. The apparatus and methods of the present invention may be simple, cost effective and/or easy to implement. Ideally, the apparatus and methods of the present invention may provide permanent, or relatively permanent, support or repair for hinge assemblies, potentially increasing the life of the hinge assemblies. Yet further, the apparatus and methods of the present invention may allow the doors with which they are used to be generally operable as originally intended. Characteristics and advantages of the present invention described above, as well as additional features and benefits, will be readily apparent to those skilled in the art upon reading the following detailed description and referring to the accompanying drawings.

BRIEF DESCRIPTION OF THE DRAWINGS

For a detailed description of preferred embodiments of the invention, reference will now be made to the accompanying drawings wherein.

DETAILED DESCRIPTION OF PREFERRED EMBODIMENTS

Figure 1:
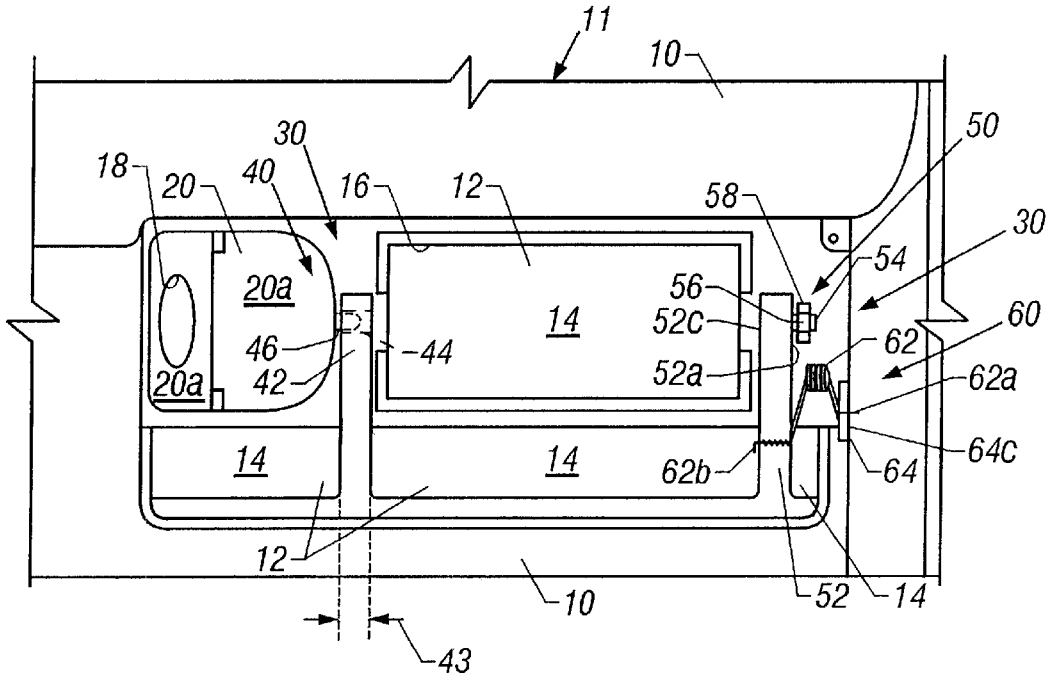
FIG. 1 (Prior Art)
FIG. 1 is a bottom view of a hinge assembly associated with an ash tray cover of a center console of an automobile, such as Ford® Mustang ® automobile manufactured in the 1987–1993 time frame, showing the ash tray cover in the closed position.

Presently preferred embodiments of the invention are shown in the above-identified figures and described in detail below. In describing the preferred embodiments, like or identical reference numerals are used to identify common or similar elements. The figures are not necessarily to scale and certain features and certain views of the figures may be shown exaggerated in scale or in schematic in the interest of clarity and conciseness. It should be understood that the following description of preferred embodiments below, the Abstract, Brief Description of the Drawings, Brief Summary of the Invention and Background of the Invention sections of this application as well as the drawings themselves, are not intended to limit the scope or construction of any of the appended claims, unless expressly stated otherwise herein or in the appended claims.

Figure 13:
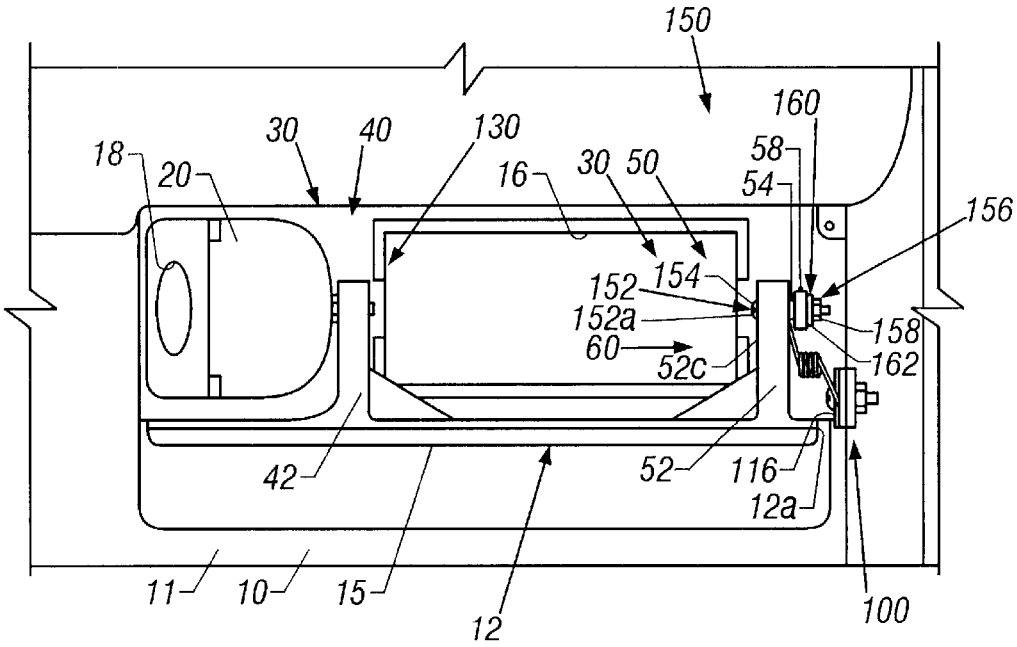
FIG. 13 is a bottom view of the hinge assembly shown in FIG. 1 with the ash tray cover in the opened position and including one embodiment of a spring support assembly, first hinge support assembly and second hinge support assembly in accordance with the present invention.

Referring initially to FIG. 1, the bottom side 14 of an ash try cover 12 disposed in the center console 10 of a Ford® Mustang® automobile manufactured in the 1987–1993 time frame is shown. In FIG. 1, the ash tray cover 12 is in the closed position. (For reference purposes, FIG. 13 shows an ash tray cover 12 in an opened position.) The ash tray cover 12 is one example of a moveable member, such as an accessory door, cover, lid or flap used in automobiles, other types of vehicles, appliances, home and office equipment and various other devices with which the present invention may be applied. As used herein and in other sections of this patent application, including the appended claims, the term "accessory door" means a moveable member, such as a door, cover, lid or flap used in automobiles, other types of vehicles, appliances, home and office equipment and various other devices, that is known or becomes known in the future. The accessory door 12 of FIG. 1 covers and allows access to an ash tray (not shown) that is accessible through an opening 16 in the console 10, and also covers a cigarette lighter (not shown) insertable into an opening 18 in a cigarette lighter cup 20 formed into, or attached to, the console 10. The console 10 (as well as its component parts) is an example of a base 11 for an accessory door. As used herein and in the appended claims and other sections of this patent application, the term "base" means a component, surface or device upon which an accessory door is movably mounted or with which the accessory door is movably connected.

Also shown in FIG. 1 is a mechanism 30 that enables the opening and closing of the accessory door 12. The mechanism 30 is an example of assemblies, or mechanisms, that enable the opening and closing, turning or pivoting of accessory doors, which are known or become known in the future, and which are referred to herein, in the appended claims and other sections of this patent application as "hinge assemblies." The hinge assembly 30 of FIG. 1 includes first and second hinges 40, 50, respectively, and biasing assembly 60. The term "first hinge" as used herein, in the appended claims and other sections of this patent application means a first assembly, or mechanism, that allows movement of an accessory door relative to an object, or surface, to which the accessory door is moveably connected. The term "second hinge" as used herein, in the appended claims and other sections of this patent application means a second assembly, or mechanism, that allows movement of an accessory door relative to an object, or surface, to which the accessory door is moveably connected. The first and second hinges are parts of a hinge assembly. The term "biasing assembly" as used herein, in the appended claims and other sections of this patent application means a portion or mechanism of a hinge assembly that provides biasing forces upon an accessory door.

The first hinge 40 of FIG. 1 includes a first L-shaped hinge arm 42, which extends downwardly from the accessory door 12 when the console 10 is disposed in an automobile (not shown). The hinge arm 42 includes a hole 44 engageable with a fixed peg 46 extending from the outside surface 20*a* of the cigarette lighter cup 20. The arm 42 is thus rotatable, or pivotable, about the peg 46, enabling the accessory door 12 to be moveable between open and closed positions relative to the opening 16 and cigarette lighter cup 20.

Still referring to FIG. 1, the second hinge 50 includes second L-shaped hinge arm 52, which also extends downwardly from the accessory door 12 when the console 10 is disposed in an automobile (not shown). The arm 52 includes a stud 54 that extends outwardly from surface 52*a* of the arm 52. Stud 54 engages and rotates within a hole 56 disposed in a finger 58 extending from the console 10. The finger 58 is stationary relative to the console 10, can be an integral portion, or extension, of the console 10, or can be connected with the console 10. Further, the finger 58 can take any suitable shape, size and configuration. The finger 58 of FIG. 1, for example, is a generally U-shaped member. Thus, arm 52 is rotatable, or pivotable, relative to the finger 58, enabling movement of the accessory door 12 between open and closed position relative to the opening 16 and cigarette lighter cup 20.

Figure 2:
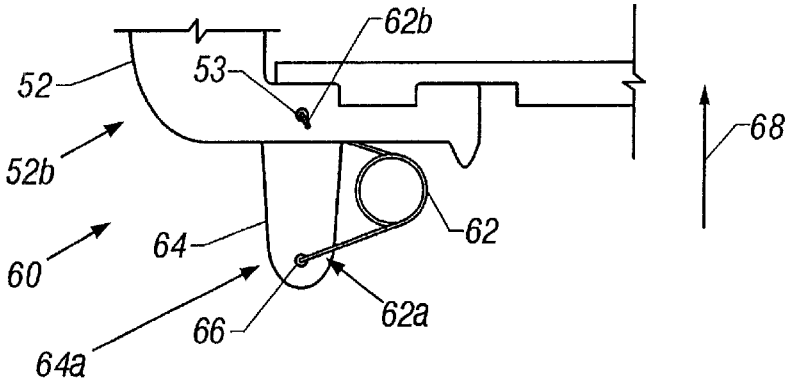
FIG. 2 (Prior Art)
FIG. 2 is a fragmentary view of the biasing assembly of the hinge assembly taken along lines 2—2 of FIG. 1.

Finally, the biasing assembly 60 of FIG. 1 includes a spring tab 64 also extending downwardly from the console 10 and a torsion spring 62. The spring 62 is engageable with the spring tab 64 at its first end 62*a*, and with the second L-shaped hinge arm 52 at it second end 62*b*. As shown in FIG. 2, the first end 62*a* of the spring 62 engages the spring tab 64 by extending into a passage 66 in the upper end 64*a* of the tab 64, and the second end 62*b* engages the arm 52 via passage 53 in arm 52. In the device of FIGS. 1 and 2, the passage 53 is located adjacent to the turn portion 52*b* of the arm 52. Further, all of the above described component parts shown in FIG. 1 are constructed of plastic, except the spring 62, which is metal. It should be understood, however, that the present invention is not limited thereby and may be used with a base 11, or apparatus, of any material composition or combinations of compositions. For example, the invention may be used with an accessory door 12, arms 42, 52 and stud 54 that are constructed of metal.

The operation of the hinge assembly 30 of FIGS. 1 and 2 will now be described. The rotation, or pivoting, of the first arm 42 relative to the peg 46 and the second arm 52 relative to the finger 58 as described above allows the accessory door 12 to be moveable between open and closed positions. With respect to the biasing assembly 60, the assembly 60 is configured so that the spring 62 is generally in constant compression between the spring tab 64 and the second L-shaped hinge arm 52, generally constantly imparting spring forces upon both the spring tab 64 and the arm 52. As a result of the configuration of the biasing assembly 60 and the biasing forces on the arm 52, the accessory door 12 is maintained, or secured, in its opened and closed positions when in such positions, respectively.

Still referring to FIGS. 1 and 2, the generally constant biasing forces on the arm 52 ensures that the accessory door 12 generally remains closed when in the closed position, and generally remains open when in the opened position, generally preventing undesired opening or closing of the accessory door 12 during use and operation of the automobile (not shown). For example, the accessory door 12 may be placed in the open position (FIG. 13) to allow access to the ash tray (not shown) while the driver is smoking a cigarette and driving. If the accessory door 12 mistakenly closes, the driver may mistakenly discard ashes, or even snub out the cigarette, on the top 15 (FIG. 13) of the accessory door 12 or otherwise in the driver's compartment (not shown) of the automobile. For another example, the accessory door 12 may be in the open position (FIG. 1) to allow connection and operation of an electronic device, such as a radar detector (not shown), via the cigarette lighter outlet (not shown) disposed in the cigarette lighter cup 20. If the accessory door 12 undesirably closes in such instance, the radar detector could become disconnected and/or the radar detector electrical wire damaged.

For either example above, or any other instance where the operator desires to have the accessory door 12 in the open or closed position, the undesired or mistaken closing or opening of the accessory door 12 could result in undue expense. For example, in the first example above, it may become necessary to clean the driver's compartment, to replace a burned accessory door 12 or other parts of the automobile, particularly if a fire is started due to the ash droppings outside the ash tray. In the second example above, it may be necessary to replace the radar detector wire and/or pay for a speeding ticket. In any case, the driver could become distracted by the undesired or mistaken opening or closing of the accessory door 12. Thus, having an accessory door 12 in console 10 that generally remains closed when closed and open when opened, and is moveable between positions generally as originally intended, can be viewed as desirable, though not necessary for the present invention.

Still referring to FIG. 1, the generally constant biasing forces on the arm 52 due to the configuration described above also assists in ease of opening and closing the accessory door 12 by the operator. For example, when the operator desires to move the door 12 from a closed to an open position (FIG. 13), he/she must overcome the "closing" spring forces on the accessory door 12 (by manually moving the door 12 in the direction of the open position) for only part of the door's range of motion. At some point during the opening of the door 12, the "opening" spring forces of spring 62 on the door 12 become greater than the "closing" spring forces on the door 12. As a result, the door 12 will automatically move, or effectively snap, into the opened position (FIG. 13). The opposite spring force effect will occur when moving the door 12 from the closed to the opened position. Consequently, though not necessary for the present invention, opening and closing the door 12 is made easier for the operator, such as the vehicle driver, reducing his/her distraction and effort.

The present invention will now be described. As used herein and elsewhere throughout the present application, the terms "invention" and "present invention" are not intended to mean the claimed invention of any particular claim or claims, or all claims, of this application. These terms are used to mean the general subject matter of this application, which may or may not be the subject of a particular claim or claims depending on the express language of the claim(s). Thus, it is not intended that use of, or reference to, the terms "invention" or "present invention" limit the construction or scope of any of the appended claims.

It should be understood that the first and second hinges and the biasing assembly of a hinge assembly need not have the same configuration, components or operation as described with respect to the device of FIGS. 1 and 2 to be used with present invention. The present invention can be used to support or reinforce a hinge assembly having a first hinge, second hinge, biasing assembly, or any combination thereof, or to repair a damaged hinge assembly that can, in fact, differ in structure, form, configuration and any other manner from the hinge assembly 30, biasing assembly 60 and first and second hinges 40, 50 shown in FIGS. 1–15 and referenced throughout this detailed description.

In one instance, it may be desirable to support, reinforce, or repair the biasing assembly of a hinge assembly. For example, referring to the device of FIGS. 1 and 2, it may be desirable to support or reinforce the spring tab 64, or to repair the spring tab 64 if the tab 64 becomes damaged or destroyed. Because the spring tab 64 must remain generally stationary and rigid relative to the console 10 for operation of the biasing assembly 60 in the configuration of FIG. 1 as described above, it is subject to significant relative forces. As a result, the tab 64 or the passage 66 (FIG. 2) in the tab 64 can deform, or the tab 64 can break, reducing the effectiveness of, or disabling, the biasing assembly 60 and thus the operation of the accessory door 12.

In accordance with the present invention, referring to FIGS. 3–6, a spring support assembly 100 is provided to support, reinforce or repair the biasing assembly 60. In the exemplary embodiments of FIGS. 3 and 5, the spring support assembly 100 includes a spring support plate 104 connectable to the console 10 and engageable with the first end 62*a* of the spring 62, and one or more spring support plate connectors 106 for connecting the plate 104 to the console 10.

Figure 3:
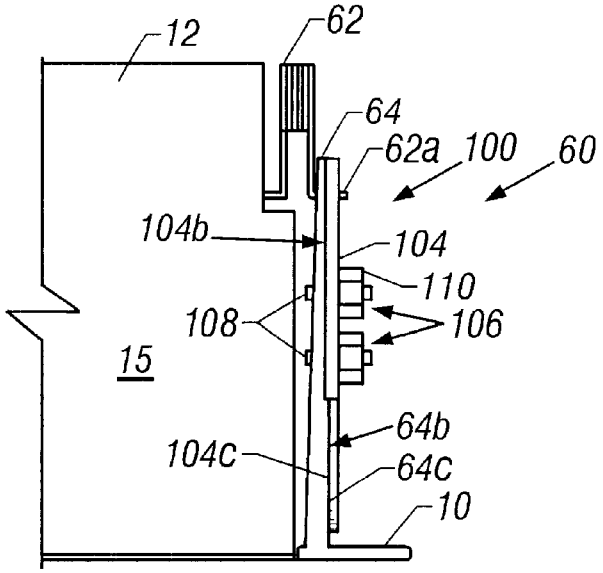
FIG. 3 is a partial front view of one embodiment of a spring support assembly of the present invention shown with a biasing assembly of the type shown in FIG. 1.
Figure 4:
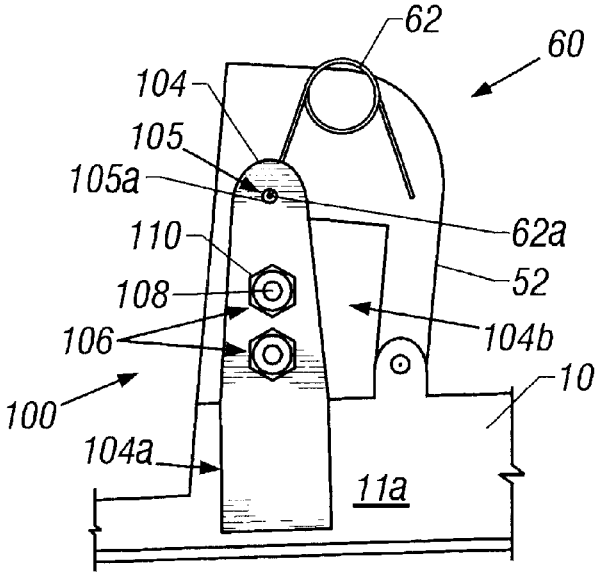
FIG. 4 is a partial side view of the spring support assembly of FIG. 3.
Figure 5:
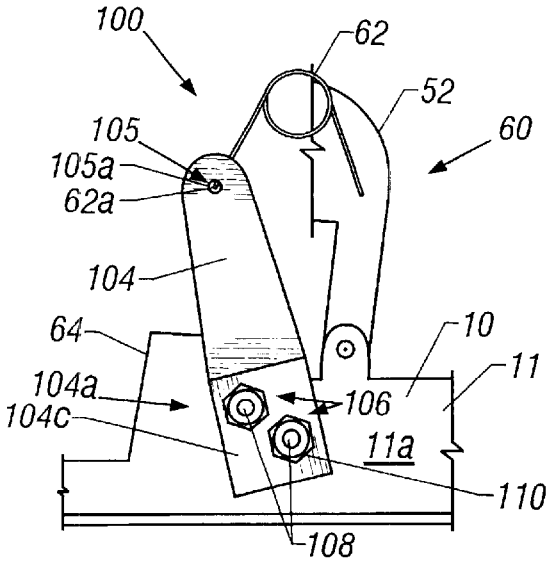
FIG. 5 is a partial side view of another embodiment of a spring support assembly of the present invention shown with a biasing assembly of the type shown in FIG. 1.
Figure 6:
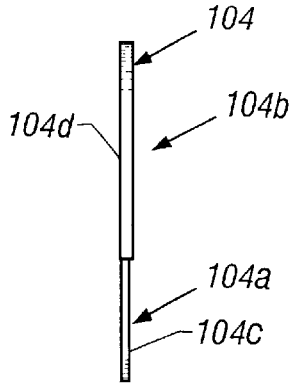
FIG. 6 is an isolated view of the spring support plate shown in FIGS. 3–5.

In the embodiments of FIGS. 3–5, the plate 104 is connected to the console 10 so that it is generally or substantially stationary, or rigid, relative to the console 10 in order to support the biasing forces of the spring 62 and otherwise allow the proper operation of the biasing assembly 60. In the example of FIGS. 3 and 4, the plate 104 is connected directly to the spring tab 64, which may be desirable in various circumstances, such as when the tab 64 or passage 66 (FIG. 2) is deformed, the spring tab 64 is partially broken, or simply to support or reinforce the spring tab 64. A pair of connectors 106 are shown extending through an adjacent pair of corresponding holes (not shown) formed in the spring tab 64 and an upper portion 104*b* of the plate 104.

In the example of FIG. 5, the plate 104 is connected to another part of the console 10, such as the ash tray base portion 11 of the console 10, which may be desirable in various circumstances, such as when the spring tab 64 is partially broken (FIG. 5), is entirely broken or otherwise will not function as a suitable anchor, or base, for the plate 104. A pair of connectors 106 in this embodiment are shown extending through an adjacent pair of corresponding holes (not shown) formed into a lower portion 104*a* of the plate 104 and the ash tray base portion 11 of the console 10.

Referring again to FIGS. 3–5, the spring support plate connector, or connectors, 106 can take any suitable form, shape and configuration. The particular connectors 106 shown in FIGS. 3–5 are removable screws 108 and corresponding nuts 110. The screws 108 can, for example, be commercially available #4×7/16 inch stainless steel, pan head screws, or any other suitable type of screw or connector, and the nuts 110 can be commercially available lock nuts, or any other suitable mechanism.

For the embodiment of FIG. 5, a suitably sized buffer mechanism, such as a washer (not shown), may optionally be disposed between the each screw 108 and the console 10 adjacent the screw head (not shown), such as to protect the console 10 from damage or wear from contact with the screw 108. Similarly for the embodiment of FIG. 3, a buffer mechanism, such as a washer (not shown), can optionally be placed between each screw 108 and the spring tab 64.

Referring again to FIGS. 3 and 5, the plate 104 can have any composition, shape and/or configuration suitable for providing support for the spring 62, or to support, reinforce or repair a spring tab 64, of a biasing assembly 60. In the particular embodiments of FIGS. 3–6, for example, the plate 104 is constructed of metal, such as stainless steel, to provide strength and rigidity. Further, the plate 104 of FIGS. 3–6 includes a spring anchor mechanism 105, which can take any suitable form and configuration, such as spring a engagement bore 105*a*, for holding, or engaging, the spring 62.

In the embodiment of FIGS. 3–4, the spring support plate 104 is shaped to fit flush against the outer surface 64*c* of the spring tab 64. The plate 104 of this embodiment includes a cut-away section 104*c* (FIG. 6) of the lower portion 104*a* of the plate 104, such that the plate 104 will fit flush against a protruding portion 64*b* of the spring tab 64. The same plate 104, however, can be used in other configurations, such as the embodiment of FIG. 5. In FIG. 5, the cut-away section 104*c* of the lower portion 104*a* is shown positioned on the outside, or facing away from the ash tray base portion 11 of the console 10. The generally flat side 104*d* (FIG. 6) of the plate 104 can thus be positioned flush against the ash tray base portion 11 of the console 10, even when the plate 104 is angularly positioned relative to the ash tray base portion 11, as shown in FIG. 5.

Figure 7:
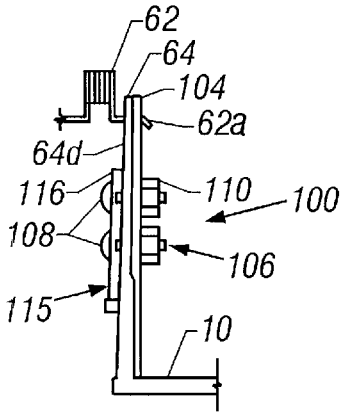
FIG. 7 is partial front view of another embodiment of a spring support assembly of the present invention shown with a biasing assembly of the type shown in FIG. 1.
Figure 8:
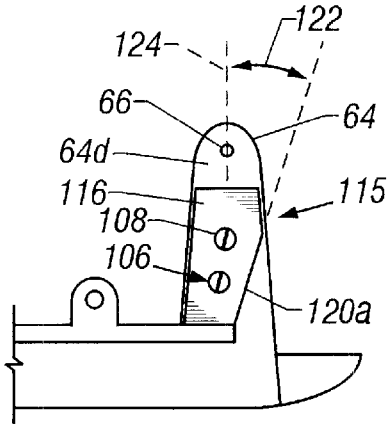
FIG. 8 is a partial side view of the embodiment of FIG. 7 with the spring removed.
Figure 9:
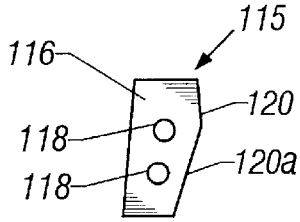
FIG. 9 is an isolated view of the backing shown in FIG. 7.

Referring to FIGS. 7–9, the spring support assembly 100 can also (optionally) include a spring reinforcement member 115, such as the backing 116, to reinforce or provide further support for the spring 62, spring tab 64 and/or spring support plate 104. The spring reinforcement member 115 can also be used to protect the spring tab 64, such as the plastic spring tab 64 shown in FIG. 8, from damage by the connector 106, such as screws 108.

The spring reinforcement member 115 can have any suitable composition, shape and/or configuration. In the embodiment of FIGS. 7–9, for example, the backing 116 is constructed of metal to provide strength and rigidity. The backing 116 of the illustrated embodiment is shaped and configured to be removably connectable to the inside surface 64*d* of the spring tab 64, opposite the spring support plate 104. This backing 116 includes a pair of adjacent holes 118 (FIG. 9) that correspond with the corresponding pairs of holes (not shown) formed in the spring tab 64 and spring support plate 104 described earlier. Thus, the connector or connectors 106, such as screws 108, that are used to connect the spring tab 64 and spring support plate 104, can also be extended through the backing 116 for securing the backing 116 in position.

Referring to the embodiment of FIGS. 7–10, the backing 116 can be formed to avoid potential interference with the adjacent edge 12*a* (FIG. 10) of the accessory door 12. For example, the backing 116 shown in FIGS. 8–9 is formed with a steeply angled portion 120*a* of side 120 such that the adjacent edge 12*a* (FIG. 10) of the accessory door 12 will not contact, or rub against, the backing 116 as the accessory door 12 is moved between opened (FIG. 13) and closed positions. The particular angle 122 of the embodiment of FIGS. 8–9 is between about 15 degrees and about 20 degrees, such as about 18 degrees, relative to the centerline 124 of the spring tab 64. Otherwise, the opening and closing movement of the accessory door 12 may be hindered. However, this feature may not be necessary or desirable depending on the configuration in each particular situation.

A different, independent aspect of the present invention will now be described, referring initially to FIGS. 1 and 10. Along with, or independent from, the use of a spring support assembly 100, it may be desirable to support, reinforce, or repair a first hinge 40 of a hinge assembly 30. For the particular example of FIG. 1, it may be desirable to support or reinforce the first hinge 40, or repair the first hinge 40 such as when the peg 46 becomes damaged, destroyed or at least partially ineffective.

Figure 10:
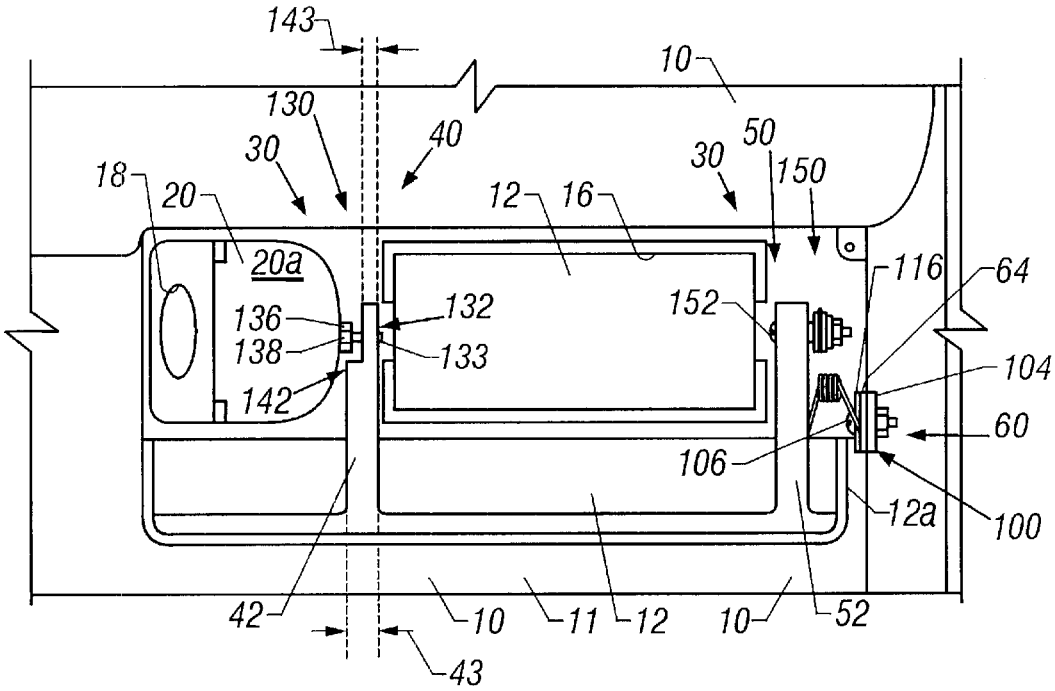
FIG. 10 is a bottom view of the hinge assembly shown in FIG. 1 and including one embodiment of a spring support assembly, first hinge support assembly and second hinge support assembly in accordance with the present invention.
Figure 11:
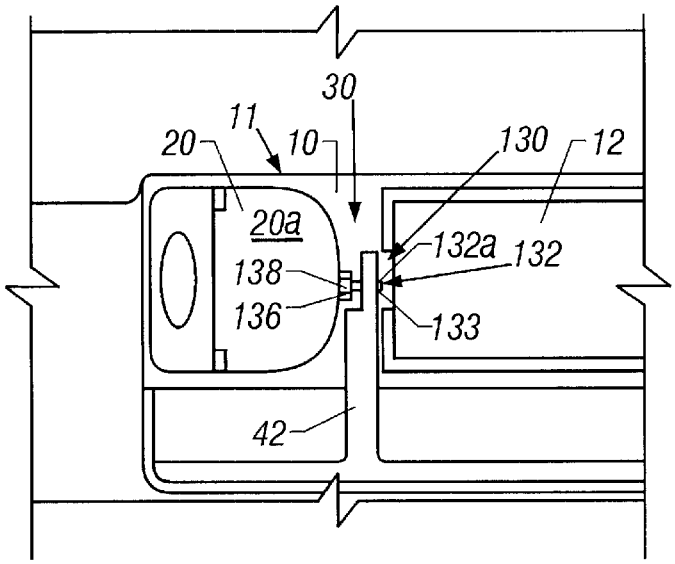
FIG. 11 is a partial exploded view of the first hinge support assembly of FIG. 10.
Figure 12:
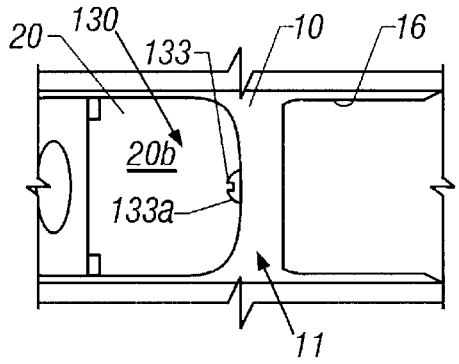
FIG. 12 is a partial top view of the first hinge support assembly of FIG. 11.

Referring now to FIGS. 10–12, in accordance with the present invention, a first hinge support assembly 130 is shown. The first hinge support assembly 130 of the embodiment shown includes a pin 132 connectable to the console 10 and engageable with the L-shaped hinge arm 42 to allow the rotation, or pivoting, of the arm 42 and thus the opening and closing of the accessory door 12.

The pin 132 can possess any suitable form, shape and configuration. In the embodiment shown in FIGS. 10–12, for example, the pin 132 is a screw 133 that is inserted through a passage (not shown) bored through the cigarette lighter cup 20 at the prior location thereon of the fixed peg 46 (FIG. 1) after the fixed peg 46 is broken or otherwise removed. The screw 133 of this particular embodiment is inserted from inside the cigarette lighter cup 20, as shown in FIG. 12, such that the screw head 133*a* of screw 133 generally abuts the inside surface 20*b* of the cup 20. The screw 133 can be a commercially available #5×3/8 inch stainless steel, pan head screw, or any other suitable screw, or pin.

The pin neck 132*a* (FIG. 11) should be of a diameter (not shown) that is the same as, or greater than, the diameter of the fixed peg 46 (FIG. 1) to generally snugly engage the hole 44 (FIG. 1) in the first L-shaped hinge arm 42. Otherwise, if the diameter of the pin neck 132*a* is less than the diameter of the peg 46, the arm 42 could slip off the pin 132, wobble or otherwise not move as desired when the accessory door 12 is being opened and closed. If the pin neck 132*a* has a diameter greater than the diameter of the fixed peg 46, then the hole 44 in arm 42 must be enlarged to accept the pin 132. In the embodiment of FIG. 11, if a #5 by 3/8 inch screw is used as screw 133, it should fit into the hole 44 without having to alter the hole 44.

Referring to FIGS. 10 and 11, a pin retention member 136 may be connected with the pin 132 to secure the pin 132 to the console 10, or base 11. In the particular embodiment shown, the pin retention member 136 is a #5 regular nut 138 that is connected with the screw 133 on the outside of the cigarette lighter cup 20, preferably generally abutting the outside surface 20*a* of the cup 20. Any other type of suitable nut, or pin retention member, may be used.

In some embodiments, such as the example of FIGS. 10 and 11, the inclusion of a pin retention member 136, such as nut 138, will require that the arm 42 be modified to allow the arm 42 to rotate, or pivot, through its normal range of motion. In FIG. 10, the arm 42 is modified by reducing the thickness 43 of arm 42 at the end portion 142*a* of the arm 42 to a thickness 143 sufficient to allow clearance of the arm 42 around nut 138 as the arm 42 rotates, or pivots. For example, the thickness 43 of the arm 42 in one embodiment is reduced sufficient to provide a clearance area for the nut 138 that is about 2.5 mm by about 10 mm in size. Modification of the arm 42 may, however, vary or be unnecessary depending upon the particular configuration of the arm 42 and the type of pin 132 and pin retention member 136 being used.

Referring again to FIGS. 1 and 10, yet another independent aspect of the present invention will now be described. Along with or independent from use of a spring support assembly 100 and/or a first hinge support assembly 130, it may be desirable to support, reinforce, or repair a second hinge 50 of a hinge assembly 30. For example, referring to the device of FIG. 1, it may be desirable to support or reinforce the second hinge 50, or repair the second hinge 50 such as when the stud 54 becomes damaged, destroyed or at least partially ineffective. It may also, or instead, be desirable to prevent the stud 54 from jumping, or being forced, out of the hole 56 in the finger 58, which may occur during opening and closing of the accessory door 12.

Figure 14:
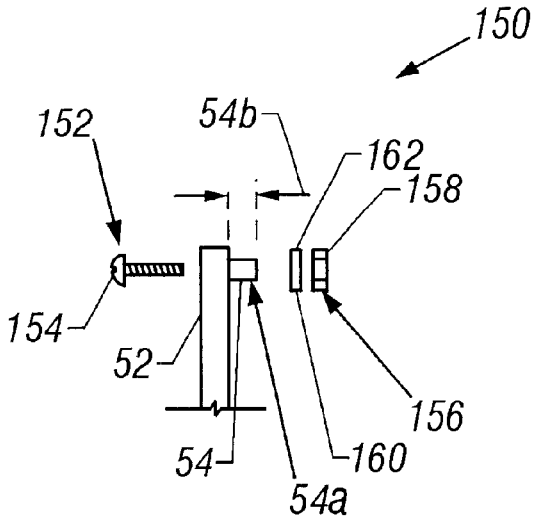
FIG. 14 is an assembly diagram of an embodiment of components of a second hinge support assembly in accordance with the present invention.
Figure 15:
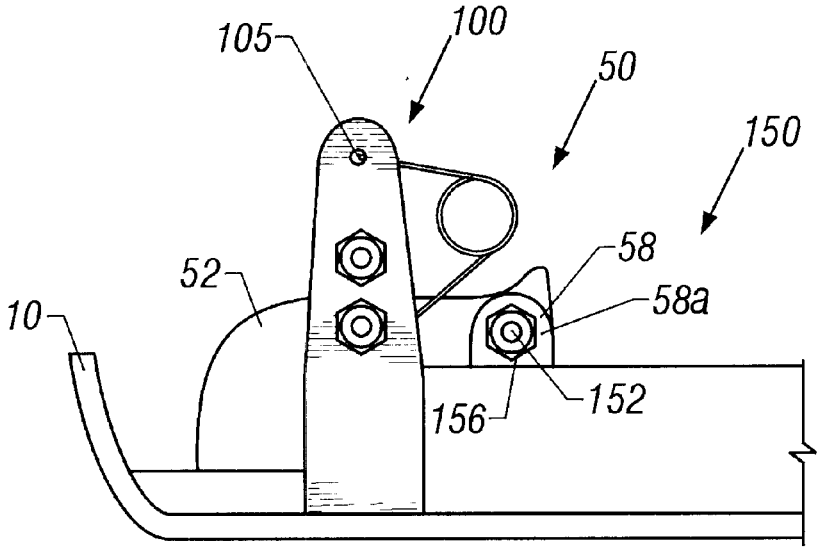
FIG. 15 is a partial side view of the second hinge support assembly shown in FIG. 13.

Referring now to FIGS. 13–15, in accordance with the present invention, a second hinge support assembly 150 is shown. For the particular example of FIG. 13, the second hinge support assembly 150 includes a pin 152 engageable between the second L-shaped hinge arm 52 and the finger 58 to allow the rotation, or pivoting, of the arm 52 and thus opening and closing of the accessory door 12. In the embodiment shown, the pin 152 generally freely rotates within the hole 56 (FIG. 1) in the finger 58, allowing the arm 52 and thus the accessory door 12 to rotate, or pivot relative to the finger 58 and console 10.

The pin 152 can take any suitable form, shape and configuration. In the preferred embodiment shown in FIGS. 13–14, the pin 152 is a screw 154 that is inserted through a passage (not shown) bored through the arm 52 and stud 54 (if the stud 54 is not removed or absent from the arm 52) and through the hole 56 (FIG. 1) in the finger 58. The screw 134 of this embodiment can be a commercially available #2×½ inch stainless steel, pan head screw, or any other suitable screw or pin.

Still referring to the embodiment of FIGS. 13 and 14, a pin retention member 156 is shown connected with the pin 152 to rotatably secure the pin 152 and arm 52 to the finger 58. In this embodiment, the pin retention member 156 is a nut 158, such as for example a #2 lock nut, that is screwed onto the screw 154 on the side of the finger 58 opposite the arm 52. Any other type of suitable nut, or pin retention member, may be used.

Yet still referring to the embodiment of FIGS. 13–14, a buffer 160, such as washer 162, may be included between the finger 58 and pin retention member 156, such as to prevent damage to the finger 58 by the pin retention member 156 and/or to accommodate, or enable smooth, rotation of the pin retention member 156 relative to the finger 58. The washer 162 may be any suitable washer, such as a #2 nylon washer. The buffer 160 could instead be any other suitable device.

Further, if the stud 54 is not broken or otherwise removed from the arm 52, it can be modified to be used with the second hinge support assembly 150. For example, referring to FIGS. 14 and 15, the length 54*b* of the stud 54 can be reduced such that the stud 54 can extend into the hole 56 (FIG. 1) in the finger 58, while not protruding beyond the outer surface 58*a* (FIG. 15) of the finger 58. In the particular embodiment shown, the length 54*b* of the stud 54 is reduced to about ⅛ inch, any excess length being removed from the end 54*a* of the stud 54. The stud 54 thus extends into the hole 56, while the pin 152 extends through the stud 54 and beyond the outer surface 58*a* of the finger 58, allowing engagement with the pin retention member 156. This modification, however, may not be necessary or desirable.

Referring to FIGS. 1 and 13, installation of the spring support assembly 100, first hinge support assembly 130, second hinge support assembly 150, or any combination thereof, of the present invention, will now be described. Because the invention is not limited to use with an automobile center console ash tray door, as described above with respect to the preferred embodiments and with references to FIGS. 1–15, the installation methods described herein may not be necessary or appropriate. Thus, the installation methods as described herein are not required for the present invention. Further, no part of the discussion herein of installation methods should be used to limit the description of the spring support assembly 100, first hinge support assembly 130, second hinge support assembly 150 above, or to any of the appended claims.

In addition, in every case, caution must be used in handling any electrical, electronic, automotive and all other apparatus, including the device being repaired or reinforced and all equipment used in installation of the present inventions. OEM's should be consulted for safety and other concerns before repairing or reinforcing any apparatus with the use of the present invention.

Referring to FIGS. 3–5, installation of the spring support assembly 100 includes connecting the spring support plate 104 with the console 10, and engaging the first end 62*a* of the spring 62 with the plate 104.

For the specific embodiments of FIGS. 3–5, corresponding holes (not shown) are formed into the plate 104 and either the spring tab 64 (FIG. 3), or another part of the console 10, such as the ash tray base portion 11 (FIG. 5), to create a passageway for the connector or connectors 106. The plate 104 is further modified, if necessary, to fit the console 10. For example, in the particular embodiment of FIGS. 3–4, the plate 104 is formed with a cut-away section 104*c* (FIG. 6) to abut the outer surface 64*c* (FIGS. 1, 3) of the tab 64, enabling the plate 104 to fit flush against the spring tab 64. Such modification may not be necessary, or other modifications necessary, depending on the particular configuration of the biasing assembly 60 being repaired or supported.

The plate 104 of FIGS. 3–5 is positioned as desired against the outside surface 64*c* (FIG. 3) of the spring tab 64 or other console component, such as the outside surface 11*a* (FIG. 5) of the ash tray base portion 11. For example, in the embodiment of FIG. 5, the plate 104 is angularly positioned as shown relative to the console 10. Further, if the same plate 104 modified as described above for FIG. 3 is used in an embodiment such as FIG. 5, the cut away section 104*c* of the plate 104 may be positioned facing away from the ash tray base portion 11. As a result, the generally flat side 104*d* (FIG. 6) of the plate 104 can be positioned generally flush against the ash tray base portion 11 of the console 10.

Still referring to FIGS. 3–5, the connector(s) 106 should be inserted through the corresponding holes (not shown) formed in spring tab 64, (FIG. 3) or console 10 (FIG. 5), and plate 104. If a washer or washers (not shown) or spring reinforcement member(s) 115 (FIG. 7), such as a backing 116, are included, such items are first inserted over each connector 106, or between each connector 106 and the spring tab 64, or console 10. Also, if the backing 116 shown in FIGS. 8–9 is used, the backing 116 must be aligned as shown, with the steeply angled portion 120*a* disposed closest to the adjacent edge 12*a* (FIG. 10) of the accessory door 12. In any case, each connector 106 is preferably inserted from the inside out, or facing away from the ash tray opening 16 (FIG. 10).

Still referring to the specific embodiments of FIGS. 3–5, the spring anchor mechanism 105 of the plate 104 is engaged with the spring, such as by extending the first end 62*a* of the spring 62 through the spring engagement bore 105*a* in the plate 104. If the passage 66 (FIG. 8) of the spring tab 64 is also being used to engage the spring 62, such as shown, for example, in FIG. 3, the end 62*a* of the spring 62 is preferably first passed through the passage 66 (not shown) and then passed through the bore 105*a*. That portion of the first end 62*a* of the spring 62, extending beyond the plate 104 can be bent, kinked, or otherwise configured, to prevent the first end 62*a* from slipping back through the bore 105*a*.

Now referring to FIGS. 10–12, installation of a first hinge support assembly 130 includes connecting the pin 132 to the console 10 and engaging the arm 42 with the pin 132.

For the particular embodiments of FIGS. 10–12, the portion of the peg 46 (FIG. 1) extending beyond the outside surface 20*a* of the cigarette lighter cup 20 should be removed from the console 10, and a passage, or hole, (not shown) drilled, or bored, through the cup 20 at that location. In one embodiment, a hole having a diameter of about 7/64" is ideal. The pin 132, or screw 133, is inserted through the passage (not shown) from inside the cigarette lighter cup 20, as shown in FIG. 12, so that the screw head 133*a* of screw 133 generally abuts the inside surface 20*b* of the cup 20. The pin retention member 136, or nut 138, is then connected with the pin 132, or screw 133, on the outside of the cigarette lighter cup 20, securing the screw 133 to the cup 20.

In embodiments such as FIGS. 10 and 11, the arm 42 should be modified by reducing the thickness 43 of arm 42 at the end portion 142*a* of the arm 42 to a thickness 143 sufficient to allow clearance of the arm 42 around the nut 138 as the arm 42 rotates, or pivots. The material of the arm 42 can be removed with any suitable device, such as a hand held grinder or utility knife, depending upon the material composition of the arm 42. Modification, if necessary, of arm 42 may vary depending upon the particular configuration of the arm 42 and the type of pin 132 and pin retention member 136 being used. Thereafter, the hole 44 of arm 42 is inserted over the pin 132.

Now referring to FIGS. 13–15, installation of a second hinge support assembly 150 includes engaging the pin 152 with the arm 54, and rotatably engaging the pin 152 with the console 10, such that the arm 52 can rotate or pivot relative to the console 10 without the pin 152 or arm 52 slipping, or undesirably disengaging, from the console 10.

For the particular embodiments shown in FIGS. 13–15, a hole, or passage, (not shown) is drilled or bored through the arm 52 and stud 54, if the stud 54 is not removed or absent from the arm 52. In one embodiment, a hole having a diameter of about 5/64" is drilled or bored. If the stud 54 is not broken, or otherwise removed, from the arm 52, it can be modified to be used with the second hinge support assembly 150. For example, as shown in FIGS. 14–15, the end 54 of the stud 54 is cut, or otherwise reduced, such that the stud 54 can extend into the hole 56 (FIG. 1) while not substantially protruding beyond the outer surface 58*a* (FIG. 15) of the finger 58. In one embodiment, the stud 54 is cut to a length 54*b* of about 1/8 inch.

Thereafter, the pin 152, or screw 154, is inserted through the passage (not shown) formed into the arm 52 and stud 54 from the inside out, such that the head 152*a* (FIG. 13) of the screw 154 is adjacent to the inside surface 52*c* of the arm 52. The pin 152 or screw 154 is then inserted into the hole 56 (FIG. 1) in the finger 58. A buffer 160, if included, and the pin retention member 156 are disposed onto the pin 152 extending beyond the outer surface 58*a* (FIG. 15) of the finger 58.

Finally, referring to FIGS. 10 and 13, after installation of the spring support assembly 100, first hinge support assembly 130, second hinge support assembly 150, or a combination thereof, the accessory door 12 is replaced onto the console 10.

It should be understood that the above installation methods need not be performed in the same order as stated above. Further, the installation of the first hinge support assembly 130, second hinge support assembly 150 and spring support assembly 100 are independent.

While preferred embodiments of this invention have been shown and described, modifications thereof can be made by one of ordinary skill in the art without departing from the spirit or teachings of this invention. The embodiments described and illustrated herein are exemplary only and are not limiting. Many variations and modifications of the apparatus and methods of the present inventions are possible and are within the scope of the inventions. Further, the apparatus and methods of the present invention offer advantages over the prior art that have not been addressed herein but are, or will become, apparent from the description herein, the appended figures and claims. Accordingly, the scope of the invention is not limited to the embodiments described herein.

What is claimed is:

1. An apparatus for supporting a hinge assembly associated with an accessory door, the accessory door moveable between open and closed positions relative to a base and including a first arm, the hinge assembly including a spring, the spring engageable between the base and the first arm, the apparatus comprising:

a plate rigidly engageable with the base, said plate including a spring anchor mechanism, said spring anchor mechanism capable of engaging the spring, and at least one connector capable of connecting said plate and the base, whereby the accessory door is moveable between open and closed positions without interference by said plate and without interference by said at least one connectors.

2. The apparatus of claim 1 wherein the base includes a spring tab and said plate is engageable with the spring tab.

3. The apparatus of claim 2 further including a spring reinforcing member engageable with said plate and the spring tab, wherein said at least one connector is connectable between said spring reinforcing member, said plate and the spring tab.

4. The apparatus of claim 3 wherein said spring reinforcing member is a backing.

5. The apparatus of claim 1 wherein said plate is disposed angularly relative to the base.

6. The apparatus of claim 5 further including at least one washer disposed between said at least one connector and the base.

7. The apparatus of claim 1 wherein the accessory door includes a second arm movably engageable with the base, the apparatus further comprising a first pin engageable with the second arm and the base.

8. The apparatus of claim 7 further including a first pin retention member engageable with said first pin, whereby said first pin retention member is disposed between the second arm and the base.

9. The apparatus of claim 8 wherein said first pin is a screw and said first pin retention member is a nut.

10. The apparatus of claim 8 wherein the second arm is modified to allow the accessory door to be moveable between open and closed positions without interference by said first pin retention member.

11. The apparatus of claim 1 wherein the base includes a finger and the first arm of the accessory door is movably engageable with the finger, the apparatus further including a second pin engageable between the finger and the first arm.

12. The apparatus of claim 11 further including a second pin retention member engageable with said second pin and capable of connecting said second pin with the finger.

13. The apparatus of claim 12 wherein said second pin is a screw and said second pin retention member is a nut.

14. The apparatus of claim 12 wherein the first arm of the accessory door includes a stud and the finger includes a hole and an outer surface, the stud being movably engageable in the hole of the finger, the apparatus further including a passage formed in the first arm and the stud, wherein said second pin is extendable through said passage.

15. The apparatus of claim 14 further including a buffer member disposed between said second pin retention member and the finger, and wherein said second pin retention member is engageable with said second pin adjacent to the outer surface of the finger.

16. The apparatus of claim 1 wherein the accessory door is an ash tray cover.

17. A repair kit for repairing a hinge assembly that enables movement of an accessory door between open and closed positions relative to a base, the accessory door including first and second arms, the base including a finger, the hinge assembly including a biasing assembly and first and second hinges, the biasing assembly including a spring, the spring engageable between the base and the first arm, the first hinge including the second arm of the accessory door and the finger of the base, the second hinge including the first arm of the accessory door, the repair kit comprising:

a plate engageable with the base and the spring, a first pin engageable with the first arm and the base, a first pin retention member engageable with said first pin and disposed between the base and the first arm, a second pin engageable with the second arm and the finger, and a second pin retention member engageable with said second pin and capable of connecting said second pin with the finger.

18. A method for supporting a hinge assembly that enables movement of an accessory door between open and closed positions relative to a base, the accessory door including first and second arms, the hinge assembly including a spring, the spring engageable between the base and the first arm, the method comprising:

forming a spring support plate with a spring anchor mechanism, engaging at least one connector between the spring support plate and the base, and engaging the spring with the spring anchor mechanism of the spring support plate, whereby the accessory door is moveable between open and closed positions without interference by the spring support plate and without interference by the at least one connector.

19. The method of claim 18 wherein the base includes a spring tab, the method further comprising engaging the at least one connector with the spring tab, the spring support plate and a spring reinforcement backing.

20. The method of claim 18 further comprising engaging a first pin between the second arm of the accessory door and the base.

21. The method of claim 20 further comprising engaging a first pin retention member with the first pin, and disposing the first pin retention member between the second arm of the accessory door and the base.

22. The method of claim 21 further comprising removing material from the second arm of the accessory door to allow the accessory door to be moveable between open and closed positions without interference by the first pin retention member.

23. The method of claim 18 wherein the base includes a finger and the first arm of the accessory door is movably engageable with the finger, the method further comprising engaging a second pin between the finger and the first arm and engaging a second pin retention member with the second pin, whereby the second pin is movably connected with the finger.

24. The method of claim 23 wherein the first arm of the accessory door includes a stud that is movably engageable with the finger, the method further comprising forming a passage through the first arm and the stud and extending the second pin through the passage.

* * * * *